US011758341B2

(12) United States Patent
Schuepbach-Wolf

(10) Patent No.: US 11,758,341 B2
(45) Date of Patent: Sep. 12, 2023

(54) COACHED FITTING IN THE FIELD

(71) Applicant: SONOVA AG, Staefa (CH)

(72) Inventor: Martina Schuepbach-Wolf, Rüti (CH)

(73) Assignee: Sonova AG, Staefa (CH)

( * ) Notice: Subject to any disclaimer, the term of this patent is extended or adjusted under 35 U.S.C. 154(b) by 80 days.

(21) Appl. No.: 17/462,323

(22) Filed: Aug. 31, 2021

(65) Prior Publication Data

US 2022/0116720 A1 Apr. 14, 2022

(30) Foreign Application Priority Data

Oct. 9, 2020 (EP) ..... 20200976

(51) Int. Cl.
*H04R 25/00* (2006.01)

(52) U.S. Cl.
CPC ..... *H04R 25/70* (2013.01); *H04R 25/505* (2013.01); *H04R 25/558* (2013.01)

(58) Field of Classification Search
CPC .... H04R 25/70; H04R 25/505; H04R 25/558; H04R 2225/41; H04R 2225/55; H04R 2225/61; H04R 2460/07
See application file for complete search history.

(56) References Cited

U.S. PATENT DOCUMENTS

| | | | | |
|---|---|---|---|---|
| 6,850,775 | B1 | 2/2005 | Berg | |
| 8,379,871 | B2 * | 2/2013 | Michael | H04R 25/50 381/314 |
| 9,774,965 | B2 | 9/2017 | Siddhartha | |
| 2011/0051963 | A1 * | 3/2011 | Barthel | H04R 25/70 381/314 |
| 2017/0127201 | A1 | 5/2017 | Roeck | |

FOREIGN PATENT DOCUMENTS

| | | |
|---|---|---|
| WO | 2015192870 | 12/2015 |
| WO | 2019120521 | 6/2019 |

* cited by examiner

*Primary Examiner* — Brian Ensey
(74) *Attorney, Agent, or Firm* — ALG Intellectual Property, LLC

(57) ABSTRACT

A method for adjusting a hearing device comprises: generating an audio stream with a microphone of the hearing device; processing the audio stream with a sound processor of the hearing device thus providing a processed audio stream and outputting the processed audio stream to a user of the hearing device; detecting a hearing situation with a hearing situation detector, wherein the hearing situation is associated with a configurable sound processing parameter adjustable by the user of the hearing device; when the hearing situation is detected, providing a user interface to the user of the hearing device for adjusting the configurable sound processing parameter; and, when the user has adjusted the configurable sound processing parameter, applying the configurable sound processing parameter to the sound processor.

12 Claims, 3 Drawing Sheets

COACHED FITTING IN THE FIELD

RELATED APPLICATIONS

The present application claims priority to EP Patent Application No. 20200976.7, filed Oct. 9, 2020, the contents of which are hereby incorporated by reference in their entirety.

BACKGROUND INFORMATION

Hearing devices are generally small and complex devices. Hearing devices can include a processor, microphone, speaker, memory, housing, and other electronical and mechanical components. Some example hearing devices are Behind-The-Ear (BTE), Receiver-In-Canal (RIC), In-The-Ear (ITE), Completely-In-Canal (CIC), and Invisible-In-The-Canal (IIC) devices. A user can prefer one of these hearing devices compared to another device based on hearing loss, aesthetic preferences, lifestyle needs, and budget.

When a hearing device is bought, usually a hearing care specialist or fitter fits the hearing device by adjusting hearing programs and parameters of these hearing programs to the needs and/or the hearing loss of the user. For example, when the user is interested in hiking and has problems with wind noises, the user may go to the office of the fitter, who may adjust the hearing device with respect to the suppressing wind noises. It may be that the fitter plays sound examples in his office, where the user can test the new settings. After that, the user has to test the new setting in the field, i.e. in the same situation, where he had problems. If he still has problems, he has to return to the fitter's office and the fitting procedure has to be repeated again.

This procedure may be cumbersome and time-consuming.

WO 2015/192 870 A1 describes a method for evaluating an individual hearing benefit, where the user can switch on and off an effect of an advanced hearing device feature, which was automatically selected based on classification of a current hearing situation.

BRIEF DESCRIPTION OF THE DRAWINGS

Below, embodiments of the present invention are described in more detail with reference to the attached drawings.

The reference symbols used in the drawings, and their meanings, are listed in summary form in the list of reference symbols. In principle, identical parts are provided with the same reference symbols in the figures.

DETAILED DESCRIPTION

Figure 1:
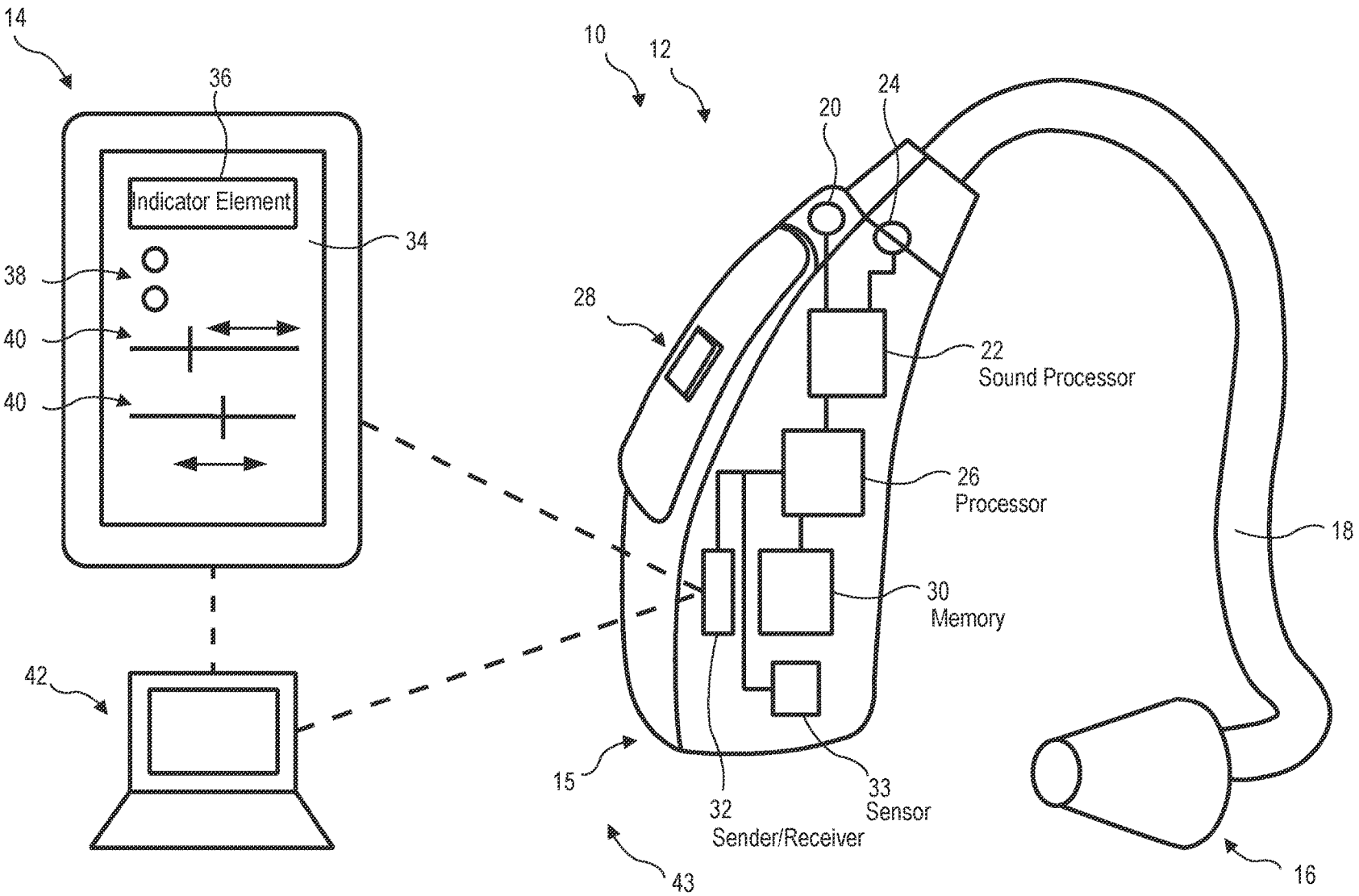
FIG. 1 schematically shows a hearing and fitting system according to an embodiment.

Described herein are a method, a computer program and a computer-readable medium for adjusting and fitting a hearing device. Furthermore, the embodiments described herein relate to a hearing and fitting system with a hearing device and optionally a mobile device.

Described herein is a feature to test, whether a setting of a hearing device made at the fitter's office is usable during the everyday life of the user of the hearing device. A further feature described herein is to improve and simplify the fitting of a hearing device.

These features are achieved by the subject-matter of the independent claims. Further exemplary embodiments are evident from the dependent claims and the following description.

A first aspect relates to a method for adjusting a hearing device. The hearing device may be part of a hearing system, which additionally may comprise a mobile device, such as a Smartphone, Smartwatch, tablet computer, etc. The hearing device may be worn by a user, for example behind the ear or in the ear. The hearing device may be a hearing aid for compensating a hearing loss of a user. Here and in the following, when to a hearing device is referred, also a pair of hearing devices, i.e. a hearing device for each ear of the user, may be meant. A hearing device may comprise one or two hearing aids and/or a cochlear implant.

According to an embodiment, the method comprises: generating an audio stream with a microphone of the hearing device and processing the audio stream with a sound processor of the hearing device thus providing a processed audio stream and outputting the processed audio stream to a user of the hearing device. The audio stream may be generated in the hearing device by digitizing a sound signal with a microphone of the hearing device. The sound processor may be controlled via sound processing parameters, which define, how the audio stream is processed, for example which frequencies are amplified and which are attenuated, which frequencies are shifted and/or whether frequency bands are compressed. The sound processing parameters also may define, how and which kind of noise is suppressed and/or whether sound from specific directions are amplified or not (which may be called beam forming). These sound processing parameters may be stored in the hearing device.

According to an embodiment, the method comprises: detecting a hearing situation with a hearing situation detector, wherein the hearing situation is associated with a configurable sound processing parameter adjustable by the user of the hearing device. The hearing situation may be determined by analyzing sensor data acquired by one or more sensors of the hearing system comprising the hearing device. For example, the hearing system may further comprise a mobile device carried by the user providing a sensor, which data is analyzed. The sensor data may comprise the audio stream, GPS data, audio data acquired by the mobile device, etc. This data may be evaluated by the hearing situation detector, which may be a program in the hearing device and/or the mobile device. The hearing situation detector may output hearing situation classification v, which are derived from the data. Examples for hearing situations, which may be classified in such a way are speech, noise, music, speech in noise, wind noise, car noise, restaurant noise, etc. For each such situation, a hearing situation classification value may be output, such as 0 and 1 or a percentage value for the probability of such a hearing situation.

The association of the hearing situation with the configurable sound processing parameter may be done by a fitter in the fitting office. With a fitting computer in data communication with the hearing device and/or the hearing system, the association may be set in the hearing device and/or the hearing system.

According to an embodiment, the method further comprises: when the hearing situation is detected, providing a user interface to the user of the hearing device for adjusting the configurable sound processing parameter, and when the user has adjusted the configurable sound processing parameter, applying the configurable sound processing parameter to the sound processor. When a hearing situation is detected with an associated configurable sound processing parameter, the user may be informed about this with the aid of a user interface. For example, this may be done with an acoustical and/or graphical user interface of the hearing system. Furthermore, the user is provided with a possibility to adjust the configurable sound processing parameter with the user interface. A user interface element may be provided to the user, where he or she can select specific values for the configurable sound processing parameter. The possible values may have been chosen by a fitter of the hearing device, for example in a fitter's office. After the selection by the user, the adjusted configurable sound processing parameter is applied to the sound processor and the user directly can decide, whether the adjusted sound parameter is better or inferior to the previous situation. In such a way, the user can test several proposals of the fitter for hearing device settings directly in the real hearing situation.

It also may be that the user is asked via the user interface, whether the real hearing situation has been identified correctly. If this is not the case, also information, such as the audio stream and/or the hearing situation may be stored, for example to be later analyzed. This may help the fitter to better define hearing situation definition data, when the user returns to his office.

According to an embodiment, the method further comprises: the hearing device comprises a set of hearing programs, each hearing program associated with a hearing situation, wherein the set of hearing programs comprises a configurable hearing program defining the configurable sound processing parameter.

According to an embodiment, each hearing program comprises sound processing parameters, which are applied to the sound processor, when the hearing program is started.

According to an embodiment, the method further comprises: starting a hearing program of the hearing device, when a hearing situation is detected by the hearing situation detector. The hearing situation detector may output classification values for hearing situations, which classification values are determined from the input sensor data to be analyzed.

The hearing device may comprises a plurality of preset hearing programs and at least one configurable hearing program. Each hearing program may comprise hearing situation definition data, which may define ranges for hearing situation classification values, in which the hearing program is started. The hearing program may be started, when the hearing situation classification values output by the hearing situation detector are in the ranges of the hearing situation definition data.

Each hearing program may comprise sound processing parameters, which are applied to the sound processor of the hearing device, when the hearing program is started.

In the hearing device, several hearing programs may be stored, which are activated and deactivated dependent on the detected hearing situation. To this end, every hearing program may define, when it should be activated and started. Furthermore, each hearing program my define the settings, which are applied to the sound processor of the hearing device, when the hearing program is started.

It may be that more than one hearing program is running at the same time. For example, the audio stream may be processed firstly by one hearing program and secondly by another hearing program.

In the hearing device, two types of hearing programs may be stored, preset hearing programs and configurable hearing programs. The preset hearing programs may not be adjusted by the user. The configurable hearing programs may be adjusted by the user, when they are started.

According to an embodiment, a configurable hearing program comprises adjustment data, the adjustment data defining at least one configurable sound processing parameter.

According to an embodiment, the configurable hearing program comprises at least two sets of sound processing parameters as adjustment data, each of which is selectable by the user. It is possible that the fitter designs several alternatives of sound processing parameters, which are stored in the configurable hearing program. The user then can switch between these alternatives of sound processing parameters and can decide, which one is the best for his needs.

According to an embodiment, the adjustment data comprise a set of selectable values for the configurable sound processing parameter. It is also possible that the fitter sets a range for one or more sound processing parameters. The user can choose a value from this range to adjust the configurable hearing program and can decide, which value from the range is the best.

According to an embodiment, the adjusted configurable sound processing parameter, which has been adjusted by the user, is stored as a default. This means that when the hearing situation associated with the configurable sound processing parameter is detected a second time, then the adjusted configurable sound processing parameter is applied to the sound processor.

According to an embodiment, the adjusted configurable sound processing parameter is stored in a configurable hearing program, for example in the corresponding adjustment data.

According to an embodiment, the hearing situation is detected by analyzing the audio stream. This may be done by a hearing situation detector provided by the hearing device.

According to an embodiment, the hearing situation is detected by analyzing a sensor signal of a further sensor different from the microphone, such as a GPS sensor or medical sensor.

According to an embodiment, the user interface is a graphical user interface of a mobile device carried by the user in data communication with the hearing device. When the hearing situation with the configurable sound processing parameter is detected, the user may be informed about this by his mobile device. An identifier and/or name of hearing situation and optionally the started configurable hearing program may be displayed on the mobile device. Furthermore, user interface elements, such as select buttons and/or sliders, may be provided for selecting sets of sound processing parameters and/or adjusting sound processing parameters within the ranges defined by the configurable hearing program.

According to an embodiment, the hearing situation detector comprises a plurality of sound classifiers, each sound classifier outputting at least one sound classification value with respect to a specific hearing situation. Each sound classifier may be a computer program run in the hearing system. The audio stream may be analyzed by each sound classifier in a specific way. The sound classifier then may output one or more values indicative of a hearing situation. For example, such a value may be a percentage value with respect to a probability of a specific hearing situation.

According to an embodiment, the hearing situation detector is provided by a mobile device of the user. The hearing situation may be detected based on sensor data acquired and analyzed by the mobile device. The detected hearing situation may be sent to the hearing device via a data communication link between the hearing device and the mobile device.

According to an embodiment, at least one of the sound classifier is based on a machine learning algorithm. For example, artificial neuronal networks, which have been trained for classifying hearing situations, may be used as sound classifier.

According to an embodiment, the sound processor is adapted for at least one of frequency dependent amplifying the audio stream, frequency shifting the audio stream and frequency compressing the audio stream in dependency of the applied sound processing parameters. Such processing may be used for compensating a hearing loss of the user of the hearing device.

According to an embodiment, the hearing device and/or the mobile device comprises at least one further sensor generating a sensor signal. For example, the wherein the further sensor is one of an acceleration sensor, a temperature sensor, a humidity sensor, a GPS sensor. It may be that the further sensor is part of a mobile device and the sensor signal is transmitted to the hearing device.

According to an embodiment, the hearing situation detector additionally analyzes sensor signal from at least two sensors, such as the microphone and a further sensor as mentioned above, and determines the hearing situation based on this. In such a way, the hearing situation may be better classified, for example, if it is rainy in the vicinity of the user and/or if the user is in the mountains, on a lake, etc.

According to an embodiment, the hearing device is a hearing aid. As already mentioned, the hearing device may be adapted for compensating a hearing loss of the user.

Further aspects relate to a computer program for adjusting a hearing device, which, when being executed by a processor, is adapted to carry out the steps of the method as described in the above and in the following as well as to a computer-readable medium, in which such a computer program is stored.

For example, the computer program may be at least partially executed in a processor of the hearing device, which hearing device, for example, may be carried by the person behind the ear. Furthermore, the computer program may be executed in a processor of a mobile device, which is in data communication with the hearing device. It may be that steps of the method are performed by the hearing device and other steps of the method are performed by the mobile device.

The computer-readable medium may be a memory of this hearing device and optionally the mobile device. In general, a computer-readable medium may be a floppy disk, a hard disk, an USB (Universal Serial Bus) storage device, a RAM (Random Access Memory), a ROM (Read Only Memory), an EPROM (Erasable Programmable Read Only Memory) or a FLASH memory. A computer-readable medium may also be a data communication network, e.g. the Internet, which allows downloading a program code. The computer-readable medium may be a non-transitory or transitory medium.

A further aspect relates to a hearing system, which comprises the hearing device and optionally a mobile device.

According to an embodiment, the hearing device comprises a microphone for generating an audio stream; a sound processor for processing the audio stream dependent on sound processing parameters, which are applied to the sound processor, thus providing a processed audio stream; a sound output device for outputting the processed audio stream to a user of the hearing device.

According to an embodiment, the hearing system comprises a hearing situation detector, for detecting a hearing situation, wherein the hearing situation is associated in the hearing system with a configurable sound processing parameter adjustable by the user of the hearing device.

According to an embodiment, the hearing system comprises a user interface for adjusting the configurable sound processing parameter by the user, when the hearing situation is detected, wherein the hearing system is adapted for applying the configurable sound processing parameter to the sound processor, when the user has adjusted the configurable sound processing parameter.

According to an embodiment, the hearing system further comprises a mobile device, wherein the user interface is provided by the mobile device. On a display of the mobile device, the determined hearing situation and/or an identifier of the started configurable hearing program may be displayed. Furthermore, graphical control elements, such as a selection button and/or a slider, may be presented, which may be used for selecting and/or adjusting sound processing parameters. The user selection may be sent back to the hearing device, which adjusts its setting accordingly.

According to an embodiment, the hearing situation detector is provided by the mobile device.

According to an embodiment, the hearing device comprises a plurality of preset hearing programs and at least one configurable hearing program, wherein each hearing program comprises hearing situation definition data, which may define ranges for hearing situation classification values and wherein each hearing program comprises sound processing parameters applicable to the sound processor; and a sound output device for outputting the processed audio stream to the user.

According to an embodiment, the hearing device is adapted for: starting one of the hearing programs, when a hearing situation associated with the hearing program is detected. This may be the case, when a specific set of hearing situation classification values is within the ranges of the hearing situation definition data of the hearing program. The sound processing parameters of the hearing program the may be applied to the sound processor.

According to an embodiment, the hearing system is adapted for: when the configurable hearing program is started, providing a user interface to a user of the hearing device for adjusting at least one sound processing parameter, wherein the configurable hearing program comprises adjustment data, the adjustment data defining at least one adjustable sound processing parameter; and when the user has selected an adjusted sound processing parameter, applying the adjusted sound processing parameters to the sound processor.

A further aspect relates to a method for fitting a hearing device. This method may be performed partially at the fitter's office and in the field. With this method, settings made by a fitter can be tested by a user in everyday situations outside of the According to an embodiment, the fitting method comprises connecting the hearing device to a fitting device, defining the hearing situation with the fitting device and storing the configurable sound processing parameter for the hearing situation in the hearing system.

According to an embodiment, the fitting method comprises: defining a configurable hearing program with the fitting device and storing the configurable hearing program in the hearing device. The configurable sound processing parameter may be stored in the configurable hearing program. With the fitting device, the hearing situation definition data and the one or more sets of sound processing parameters for the configurable hearing program may be defined and uploaded to the hearing device. In particular, the adjustment data may be defined and uploaded to the hearing device, such as specific sound processing parameters, which may be adjusted by the user and possible value ranges for these sound processing parameters.

The fitting device may establish a data communication with the hearing device and/or the mobile device and may download and/or upload settings of the hearing device and/or the mobile device. These settings may be inspected and/or adjusted with a fitting software running in the fitting device. The fitting device, which may be a PC, may be situated at a fitter's office.

According to an embodiment, the fitting method further comprises: performing the adjusting method as described above and below. For example, after the one or more configurable hearing programs have been defined, the user may adjust the configurable hearing program. In such a way, the user can test directly in the specific hearing situation, which kind of settings are better for him.

According to an embodiment, the fitting method further comprises: defining a preset hearing program with the fitting device, wherein the preset hearing program comprises the hearing situation classification values of the configurable hearing program and a set of adjusted sound processing parameter adjusted by the user. In such a way, the settings proposed by the fitter can be tested by the user in the field.

In the end, when the user has tested different sets of sound processing parameters and/or has adjusted sound processing parameters as allowed by the fitter, he may return to the fitter's office, where the configurable hearing program is transformed into a preset hearing program, where the best matching settings are taken over. In such a way, repeated visits of the user at the fitter's office may be avoided.

A further aspect relates to a fitting system, which comprises a hearing system and a fitting device, which is adapted for performing the method as described above and below.

It has to be understood that features of the methods as described in the above and in the following may be features of the computer program, the computer-readable medium and the hearing system and the fitting system as described in the above and in the following, and vice versa.

These and other aspects will be apparent from and elucidated with reference to the embodiments described hereinafter.

FIG. 1 schematically shows a hearing system 10 with a hearing device 12 in the form of a behind-the-ear device and a mobile device 14. It has to be noted that the hearing device 12 is a specific embodiment and that the method described herein also may be performed by other types of hearing devices, such as in-the-ear devices.

The hearing device 12 comprises a part 15 behind the ear and a part 16 to be put in the ear channel of a user. The part 15 and the part 16 are connected by a tube 18. In the part 15, a microphone 20, a sound processor 22 and a sound output device 24, such as a loudspeaker, are provided. The microphone 20 acquires environmental sound and generate a sound signal, which is converted into an audio stream. The sound processor 22 amplifies the audio stream and the sound output device 24 generates sound that is guided through the tube 18 and the in-the-ear part 16 into the ear channel of the user.

The hearing device 12 may comprise a processor 26, which is adapted for adjusting sound processing parameters of the sound processor 22. For example, with the sound processing parameters, an output volume of the audio stream may be frequency dependent adjusted. These sound processing parameters are determined by a computer program run in the processor 26, which will be described below in more detail. In particular in specific hearing situations, a configurable hearing program with specific sound processing parameters may be started and the user may configure specific parameters of the hearing device and/or of the configurable hearing program with a user interface.

For example, the user interface may be an acoustical user interface, which is provided by specific sounds generated by the hearing device 12. With a knob 28 of the hearing device 12, the user may generate commands to configure the configurable sound processing parameter.

All these functions may be implemented as computer programs stored in a memory 30 of the hearing device 12 and/or the mobile device 14, which computer programs may be executed by the processor 22.

The hearing device 12 also may comprise a sender/receiver 32 for data communication with the mobile device 14, which may be a smartphone or tablet computer. The user interface mentioned above also may be provided by the mobile device 14 as graphical user interface 34. An indicator element 36 may indicate the currently selected configurable hearing program and the user may select different parameter sets of the configurable hearing program with a selector element 38 and/or may adjust specific parameters with graphical elements, such as slider elements 40.

It also may be that the hearing device 12 and/or the mobile device 14 comprises a sensor 33, such as an acceleration sensor, a temperature sensor, a humidity sensor, a GPS sensor, etc.

FIG. 1 furthermore shows a fitting device 42, such as a PC, which may be situated in a fitter's office. The fitting device 42 is adapted for starting data communication with the hearing device 12 and optionally with the mobile device 14. Configurable hearing programs may be generated with the fitting device 42 and stored in the hearing device 12. The fitting device 42 may read out adjustments and selections made by the user with the user interface 34. Corresponding parameters of the configurable hearing program also may be read out of the hearing device 12 and optionally the mobile device 14.

The fitting device 42 together with the hearing system 10 may be seen as a fitting system 43.

Figure 2:
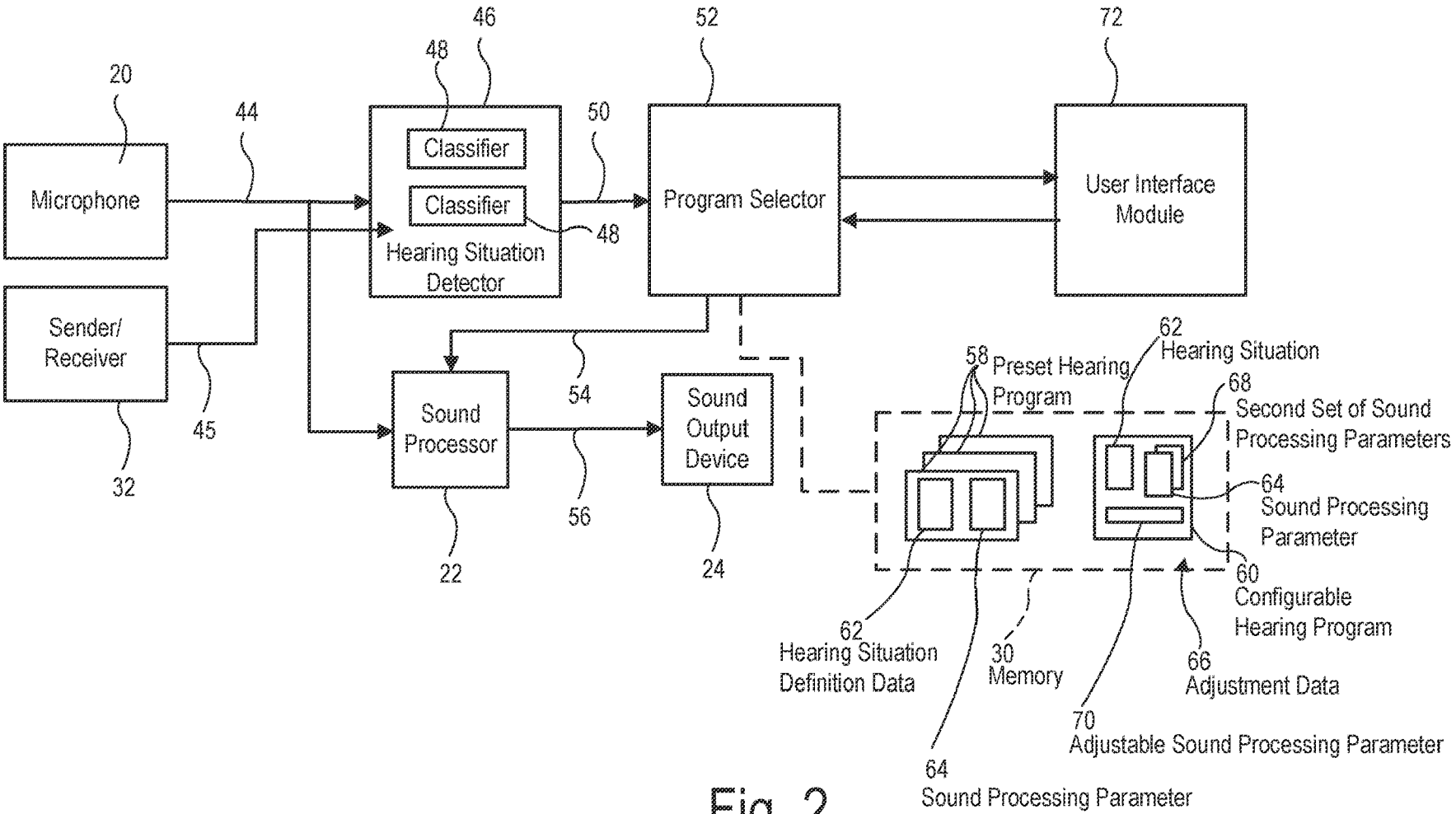
FIG. 2 schematically shows a functional diagram of a hearing system illustrating a method for adjusting a hearing device according to an embodiment.

FIG. 2 shows a functional diagram of the hearing system 10. Also a method for adjusting the hearing device 12 will be illustrated with respect to FIG. 2.

The microphone 20 of the hearing device 12 generates an audio stream 44, which may be supplied to a hearing situation detector 46. If the hearing device 12 and/or the mobile device 14 has a further sensor 33, the sensor signal 45 additionally or alternatively may be supplied to the hearing situation detector 46. The hearing situation detector 46 analyzes the audio stream 44 and/or the sensor signal 45 and determines hearing situation classification values 50. The hearing situation detector 46 may be implemented as software module in the hearing device 12 and/or the mobile device 14 and/or may be executed by a processor 26.

The hearing situation classification values 50 may be indicative of a specific hearing situation in the environment of the user. For example, the hearing situation classification values 50 may be probability values for specific features, which can be extracted from the audio stream, such as wind noises, car noises, music, etc.

One or more of the hearing situation classification values 50 may be determined with a sound classifier 48, i.e. a computer program adapted for identifying a specific hearing situation. The hearing situation detector 46 may comprise a plurality of sound classifiers 48. Each sound classifier 48 may output at least one sound classification value 50 with respect to a specific hearing situation. It also may be that at least one of the sound classifiers 48 is based on a machine learning algorithm. For example, such a classifier 48 may be based on a neuronal network and/or may have been trained with classified audio streams.

The sound classification values 50 are input into a program selector 52, which, when specific criteria are met for a hearing situation, starts a corresponding hearing program. The program selector 52 may be implemented as software module in the hearing device 12 and/or may be executed by the processor 26.

A hearing program 58, 60 is started by applying sound processing parameters 54 to the sound processor 22. The sound processor 22 processes the audio stream 44 with the actual applied sound processing parameters 54. For example, the sound processor 22 is adapted for at least one of frequency dependent amplifying the audio stream 44, frequency shifting the audio stream 44 and frequency compressing the audio stream 44 in dependency of the applied sound processing parameters 54. The amplification and/or frequency shifting may be encoded with the sound processing parameters 54.

The processed audio stream 56 is output with the sound output device 24, such as a loudspeaker, to the user.

The hearing programs 58, 60 are stored in the memory 30 of the hearing device 12. Each hearing program 58, 60 may comprise a data structure encoding, in which hearing situation the hearing program 58 is started and which sound processing parameters 54 are applied to the sound processor 22 in this case. In general, the hearing device 12 comprises a plurality of preset hearing programs 58 and at least one configurable hearing program 60.

A hearing program 58, 60 may started, when a specific set of hearing situation classification values 50 is determined by the hearing situation detector 46.

Each hearing program 58, 60 may comprise hearing situation definition data 62 defining ranges for hearing situation classification values 50. When the hearing situation classification values 50 are within these ranges, it is assumed that the hearing situation is met and the corresponding hearing program is started.

Furthermore, each hearing program 58, 60 comprises sound processing parameters 64, which are applied to the sound processor 22, when the hearing program 58, 60 is started.

The preset hearing programs 58 and the configurable hearing program 60 are different in that the configurable hearing program 60 also defines possibilities, how the user is able to adjust sound processing parameters 64. The configurable hearing program 60 may comprise adjustment data 66, which defines at least one configurable sound processing parameter. At least, the configurable hearing program 60 comprises at least one association with a configurable sound processing parameter. For example, the configurable hearing program 60 may comprise at least two sets of sound processing parameters 64, 68 as adjustment data 66, each of which is selectable by the user. It also may be that the adjustment data 66 defines a set of selectable values for an adjustable sound processing parameter 70.

When the configurable hearing program 60 is started, this information is sent to a user interface module 72. The user interface module 72, which may be a software module executed in the mobile device 14, may inform the user about the starting of the configurable hearing program 60. For example, a name of the configurable hearing program 60 may be displayed with the indicator element 36.

Furthermore, information on the possible adjustments may be sent to the user interface module 72, for example, that the user can select different sets of sound processing parameters 64, 68 and/or that different values are selectable for an adjustable sound processing parameter 70. This information may be encoded in the adjustment data 66 and/or may be provided to the user with a selector element 38 and/or one or more slider elements 40.

When the user has selected and/or adjusted one or more configurable sound processing parameters with the user interface 34, this information is sent back to the program selector 52. The program selector 52 then applies the adjusted sound processing parameters 54 to the sound processor 22. The hearing device 12 processes the audio stream 44 in a different way and the user can directly hear the difference.

The above described adjustment method may be used for providing newly configured hearing programs to a user, such that the user can test these hearing programs directly in corresponding hearing situations.

Figure 3:
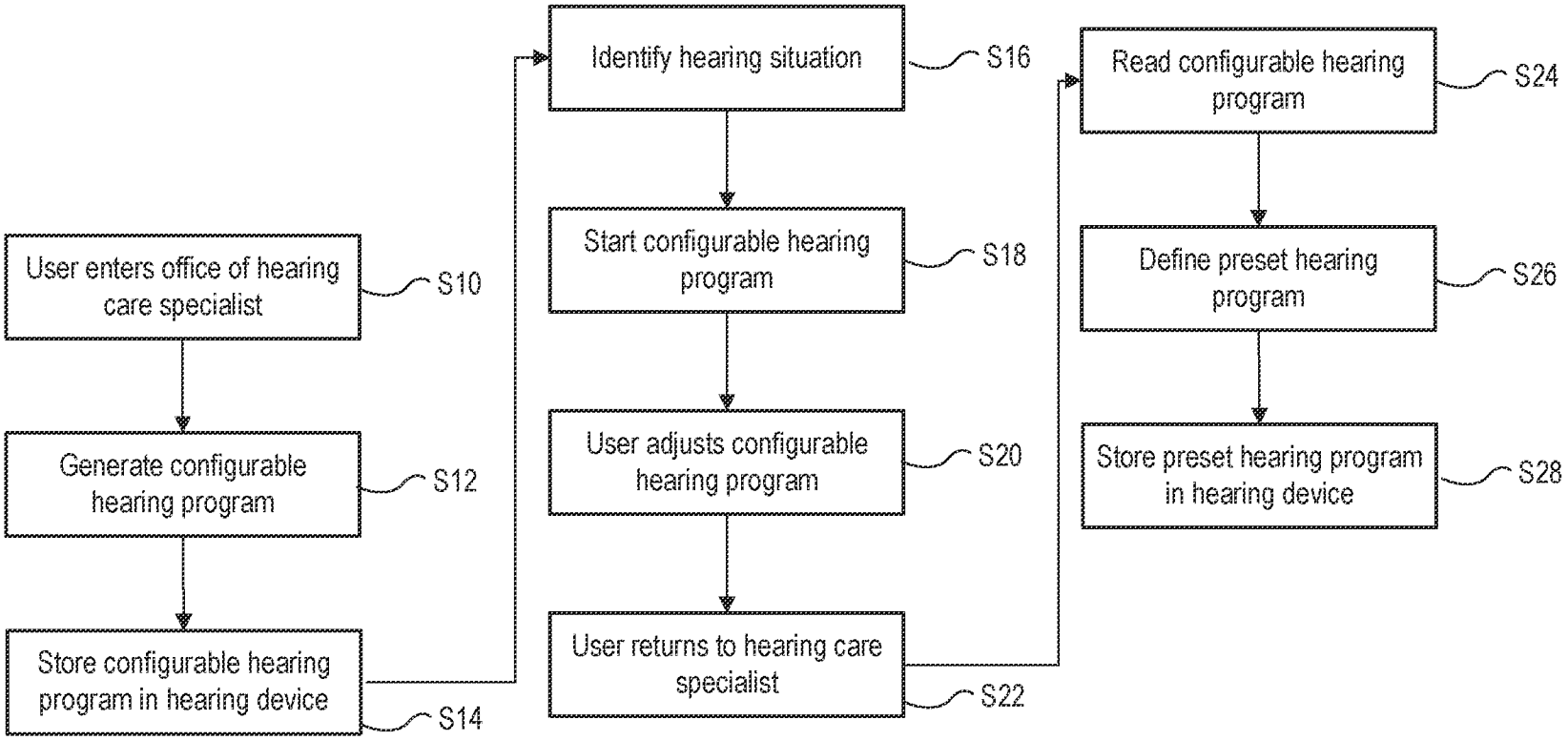
FIG. 3 shows a flow diagram for a method for fitting a hearing device according to an embodiment.

This will be described in more detail with respect to FIG. 3, which show a flow diagram for a method for fitting a hearing device 12. This method may be performed by the fitting system as shown in FIG. 1, i.e. the hearing device 12, the mobile device 13 and the fitting device 42.

In step S10, the user enters the office of a hearing care specialist (or fitter), either for buying a new hearing device 12 or because he is not content with the functionality of the hearing device 12. The user is asked by the fitter, in which hearing situation adaptions should be made.

In step S12, the fitter generates a configurable hearing program 60 for the hearing device 12 of the user. This is done with the fitting device 42, which may read out the configuration of the hearing device 12. For example, a configurable hearing program 60 may be made by adjusting a preset hearing program 58 with the fitting device 42. Such adjusting may not be possible to be performed with the hearing system 10 alone. Furthermore, the fitter usually has much more experience in adjusting sound processing parameters 64 and in defining hearing situation definition data as the user.

In the configurable hearing program 60, also the adjustment data 66 is defined with the fitting device 42. For example, the fitter can generate more than one set of the sound processing parameters 64, 68 and/or may define, which sound processing parameters can be adjusted by the user and in which extent.

In step S14, the configurable hearing program 60 is stored in the memory 30 of the hearing device 12 by the fitting device 42. It also may be that the fitting device 42 installs a computer program in the mobile device 14, which is adapted to communicate with the hearing device 12 and to provide the user interface 34. The configurable hearing program 60 also may be stored in the mobile device 14.

The user is then asked to leave the fitter's office and to go in the specific hearing situation, where the configurable hearing program 60 can be tested.

In step S16, the user enters such a hearing situation and the hearing system 10 identifies the hearing situation of the configurable hearing program 60 as described above.

In step S18, the configurable hearing program 60 is started and/or the user may select to the configurable hearing program 60. The user may be informed about this with the user interface 34.

In step S20, the user adjusts the configurable hearing program 60, for example, by selecting one of different sets of sound processing parameters or by adjusting a configurable sound processing parameter. The user can compare the different proposed settings directly in the real hearing situation and choose a setting of sound processing parameters 54, which is optimal according to his opinion.

It also may be that the hearing situation classification values 50, which have been determined at the time, when the configurable hearing program has been selected by the user and/or has been started, are stored in the configurable hearing program 60, for example in the hearing situation definition data 62. The sound definition data 62 of the configurable hearing program 60 also may be adjusted to the hearing situation classification values 50, which have been determined at the time, when the configurable hearing program 60 has been selected by the user and/or has been started.

In step S22, the user returns to the fitter's office.

In step S24, the configurable hearing program 60 and optionally the adjustments of the user are read out of the hearing system 10 with the fitting device 42. It also is possible that the user tells the fitter, which settings are the most preferred one for him. These settings are selected by the fitter in the fitting device 42.

In step S26, the fitter defines a preset hearing program 58 with the fitting device 42, wherein the preset hearing program 58 may comprise the hearing situation classification values 50 of the configurable hearing program 60 and a set of adjusted sound processing parameters 64 adjusted by the user. The fitter may further adjust the preset hearing program 58 with the fitting device 42.

In step S28, the preset hearing program 58 is stored in the memory of the hearing device 12 and/or the mobile device 10. This preset hearing program 58 may be much better adjusted to the needs of the user as other preset hearing programs 58, which solely may have been designed for a class of users and/or which are not individually adjusted.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practising the claimed invention, from a study of the drawings, the disclosure, and the appended claims. In the claims, the word "comprising" does not exclude other elements or steps, and the indefinite article "a" or "an" does not exclude a plurality. A single processor or controller or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

LIST OF REFERENCE SYMBOLS

10 hearing system
12 hearing device
14 mobile device
15 part behind the ear
16 part in the ear channel
18 tube
20 microphone
22 sound processor
24 sound output device
26 processor
28 knob
30 memory
32 sender/receiver
33 sensor
34 graphical user interface
36 indicator element
38 selector element
40 slider element
42 fitting device
43 fitting system
44 audio stream
46 hearing situation detector
48 classifier
50 hearing situation classification values
52 program selector
54 actual sound processing parameters
56 processed audio stream
58 preset hearing program
60 configurable hearing program
62 hearing situation definition data
64 sound processing parameters
66 adjustment data
68 second set of sound processing parameters
70 adjustable sound processing parameter
72 user interface module

The invention claimed is:

1. A method for adjusting a hearing device, the method comprising:

generating an audio stream with a microphone of the hearing device;

processing the audio stream with a sound processor of the hearing device thus providing a processed audio stream and outputting the processed audio stream to a user of the hearing device;

detecting a hearing situation with a hearing situation detector, wherein the hearing situation is associated with a configurable sound processing parameter adjustable by the user of the hearing device;

when the hearing situation is detected, providing a user interface to the user of the hearing device for adjusting the configurable sound processing parameter; and when the user has adjusted the configurable sound processing parameter, applying the adjusted configurable sound processing parameter to the sound processor.

2. The method of claim 1, wherein:

the hearing device comprises a set of hearing programs, each hearing program associated with a hearing situation; and the set of hearing programs comprises a configurable hearing program defining the configurable sound processing parameter.

3. The method of claim 2, wherein:

each hearing program comprises sound processing parameters, which are applied to the sound processor, when the hearing program is started; and a hearing program is started, when the hearing situation associated with the hearing program is detected.

4. The method of claim 2, wherein the configurable hearing program comprises at least two sets of sound processing parameters, each of which is selectable by the user as configurable sound processing parameters.

5. The method of claim 2, wherein the configurable hearing program comprises a set of selectable values for the configurable sound processing parameter.

6. The method of claim 1, wherein:

the adjusted configurable sound processing parameter, which has been adjusted by the user, is stored as a default; and the adjusted configurable sound processing parameter is stored in a configurable hearing program.

7. The method of claim 1, wherein the user interface is a graphical user interface of a mobile device carried by the user and in data communication with the hearing device.

8. The method of claim 1, wherein at least one of:

the hearing situation is detected by analyzing the audio stream; or the hearing situation is detected by analyzing a sensor signal of a further sensor different from the microphone.

9. The method of claim 1, wherein the hearing situation detector is provided by a mobile device of the user.

10. A computer program for adjusting a hearing device, which, when being executed by a processor, is configured to carry out the steps of the method of claim 1.

11. A hearing system comprising a hearing device, the hearing device comprising:

a microphone for generating an audio stream;

a sound processor for processing the audio stream dependent on sound processing parameters, which are applied to the sound processor, thus providing a processed audio stream; and a sound output device for outputting the processed audio stream to a user of the hearing device;

the hearing system comprising:

a hearing situation detector, for detecting a hearing situation, wherein the hearing situation is associated with a configurable sound processing parameter adjustable by the user of the hearing device; and a user interface for adjusting the configurable sound processing parameter by the user, when the hearing situation is detected;

wherein the hearing system is adapted for applying the configurable sound processing parameter to the sound processor, when the user has adjusted the configurable sound processing parameter.

12. The hearing system of claim 11, further comprising:

a mobile device, wherein at least one of:

the user interface is provided by the mobile device; or the hearing situation detector is provided by the mobile device.

* * * * *